US011589676B2

(12) United States Patent
Rettig

(10) Patent No.: US 11,589,676 B2
(45) Date of Patent: Feb. 28, 2023

(54) MODULAR CLEANING, DISPLAY, AND STORAGE RACK FOR FIREARMS

(71) Applicant: Mark Wayne Rettig, Bessemer, AL (US)

(72) Inventor: Mark Wayne Rettig, Bessemer, AL (US)

( * ) Notice: Subject to any disclaimer, the term of this patent is extended or adjusted under 35 U.S.C. 154(b) by 0 days.

(21) Appl. No.: 17/649,118

(22) Filed: Jan. 27, 2022

(65) Prior Publication Data

US 2022/0232972 A1 Jul. 28, 2022

Related U.S. Application Data

(60) Provisional application No. 63/142,302, filed on Jan. 27, 2021.

(51) Int. Cl.
*A47B 81/00* (2006.01)
*F41A 23/18* (2006.01)

(52) U.S. Cl.
CPC ..... *A47B 81/005* (2013.01); *F41A 23/18* (2013.01)

(58) Field of Classification Search
CPC ..... A47B 81/005; F41A 23/18; F41C 33/06
See application file for complete search history.

(56) References Cited

U.S. PATENT DOCUMENTS 945,520 A * 1/1910 Greenwood ..... F41A 23/18 248/175
1,579,553 A * 4/1926 Ludlow ..... F41C 33/0245 224/547
2,877,689 A * 3/1959 Pribis ..... F41A 23/00 73/167
2,939,587 A * 6/1960 Kondziolka ..... A47B 81/005 211/64
3,031,069 A 4/1962 Hirsch
3,329,278 A * 7/1967 Pachmayr ..... F41A 23/18 248/68.1
3,345,027 A 10/1967 Taylor
3,731,818 A * 5/1973 Young ..... A47B 81/005 211/64
4,050,662 A 9/1977 Pickering
5,143,227 A 9/1992 Schubert
(Continued)

FOREIGN PATENT DOCUMENTS

EP 0959318 A3 * 10/2000

*Primary Examiner* — Stanton L Krycinski
(74) *Attorney, Agent, or Firm* — Squire Patent Consulting & IP Law LLC; Brendan E. Squire

(57) ABSTRACT

A modular cleaning, display, and storage rack for firearms is disclosed for holding or displaying one or more pistols. The firearms rack can hold one or more pistols for cleaning and/or displaying. The firearms rack can also be folded flat for easy storage and/or transport. Multiple racks can be nested or stacked together and occupy less space than a single rack. The rack includes a base, and a plurality of support rods disposed in a spaced apart relation and hingedly operable relative to the base. In an open condition, the plurality of support rods are angularly disposed above a top surface of the base. The firearm is supported on the support rod by insertion of the support rod into the barrel of the firearm. In a closed position, the plurality of support rods are oriented such that they are substantially aligned with a back surface of the base.

16 Claims, 6 Drawing Sheets

(56) References Cited

U.S. PATENT DOCUMENTS 5,188,328 A * 2/1993 Thompson ..... F41C 33/048 248/309.2
5,503,276 A 4/1996 Pierce
5,520,291 A 5/1996 Graham
5,806,739 A * 9/1998 Wood ..... F41A 23/18 224/555
6,488,148 B1 * 12/2002 Woodson ..... B65D 25/10 206/317
6,711,845 B2 3/2004 Dubois et al.
6,843,081 B1 * 1/2005 Painter ..... F41C 33/06 42/70.11
7,584,861 B2 9/2009 Werner
7,735,253 B2 * 6/2010 Giebel ..... F41A 23/18 42/70.11
8,006,424 B1 * 8/2011 Ligard ..... F41A 17/02 42/70.11
8,020,332 B2 9/2011 Giebel et al.
8,281,511 B1 10/2012 Ligard
8,739,982 B2 6/2014 Werner
9,347,729 B2 * 5/2016 Hancosky ..... F41A 23/18
9,370,277 B2 * 6/2016 Weaver ..... A47J 47/16
9,574,847 B2 * 2/2017 Rossi ..... F41C 33/048
10,018,441 B1 7/2018 Kinsella
10,234,236 B2 * 3/2019 Patterson ..... F41C 33/048
D847,488 S * 5/2019 McGrath ..... D3/201
10,321,758 B2 6/2019 Martinage
10,448,735 B2 * 10/2019 Carpenter ..... F16B 9/054
10,494,856 B2 * 12/2019 Bernkrant ..... F41C 33/029
11,006,746 B2 * 5/2021 Smith ..... A47B 81/005
2006/0027514 A1 2/2006 Carlson et al.
2012/0255979 A1 * 10/2012 Sitz ..... F41C 33/0245 42/90
2012/0261368 A1 10/2012 Klein et al.
2016/0003572 A1 1/2016 Debock et al.
2016/0045024 A1 * 2/2016 Roberts ..... A47B 81/005 248/512
2020/0054129 A1 * 2/2020 Woods ..... A47B 81/005

* cited by examiner

MODULAR CLEANING, DISPLAY, AND STORAGE RACK FOR FIREARMS

CROSS-REFERENCE TO RELATED APPLICATION

This application claims the benefit of priority of U.S. provisional application No. 63/142,302 filed Jan. 27, 2021, the contents of which are herein incorporated by reference.

BACKGROUND OF THE INVENTION

The present invention relates to firearms, and more particularly to racks for the carriage of firearms.

Storing and/or displaying pistols can take up a good deal of space. If not properly stored, the firearm can become scratched, such as when the firearm is laid flat on a surface or otherwise loosely carried.

While pistol racks are helpful for displaying and/or storing pistols, they are often bulky and difficult to store when not in use. Likewise, most pistol racks do not assist the firearms owner with cleaning and maintenance of their firearm.

As can be seen, there is a need for improved rack for the cleaning, display, and storage of firearms.

SUMMARY OF THE INVENTION

In one aspect of the present invention, a storage rack for a firearm is disclosed. The storage rack includes a base formed as a substantially flat plate having a front surface and a back surface. A hinge is operable along a longitudinal length of the base and rotationally coupled with the base via a hinge pin. A plurality of support rods disposed in a spaced apart relation along a longitudinal length of the hinge, each of the plurality of support rods dimensioned to be received within a barrel of the firearm, the plurality of support rods operable between a stowed position, in which the plurality of support rods are substantially aligned with a back surface of the base, and an open position, in which the plurality of support rods are carried in an angular orientation overlying the front surface of the base.

In some embodiments, an arm protrudes from each of a first end and a second end of the base defining a notch along the longitudinal length of the base. The hinge pin is received in the arm and the hinge is rotationally received within the notch.

In some embodiments, the plurality of support rods abut with an inner edge of the notch.

In some embodiments, a recess is defined in the back surface of the base;

the recess dimensioned to receive the plurality of support rods when moved to the stowed position.

In some embodiment, a channel defined across transversely across the back surface of the base.

In some embodiments, the hinge is a piano hinge. In the open position, a proximal end of the plurality of support rods abut a top surface of the base to maintain the plurality of support rods in the angular orientation.

In some embodiments, the plurality of support rods are rotationally carried in unison about the hinge pin. In other embodiments, each of the plurality of support rods are individually rotatable about the hinge pin.

In other aspects of the invention, a storage rack for a firearm is disclosed. The storage rack includes a base having a front surface and a back surface. A plurality of support rods are disposed in a spaced apart relation along a longitudinal length of the base. Each of the plurality of support rods are dimensioned to be received within a barrel of the firearm. The plurality of support rods are rotationally coupled with the base and operable between a stowed position, in which the plurality of support rods are substantially aligned with a back surface of the base, and an open position, in which the plurality of support rods are carried in an angular orientation overlying the front surface of the base.

In some embodiments, an arm protrudes from each of a first end and a second end of the base defining a notch along the longitudinal length of the base. A hinge is rotationally received within the notch, wherein the plurality of support rods are carried on the hinge.

In some embodiments, a recess is defined in the back surface of the base. The recess is dimensioned to receive the plurality of support rods when moved to the stowed position.

In some embodiments, a channel is defined across transversely across the back surface of the base.

In some embodiments, a piano hinge is disposed along a longitudinal length of the piano hinge carrying the plurality of support rods. In the open position, a proximal end of the plurality of support rods abut a top surface of the base to maintain the plurality of support rods in the angular orientation.

In some embodiments, the plurality of support rods are rotationally carried in unison about the base. In other embodiments, each of the plurality of support rods are individually rotatable about the base.

These and other features, aspects and advantages of the present invention will become better understood with reference to the following drawings, description and claims.

DETAILED DESCRIPTION

Figure 1:
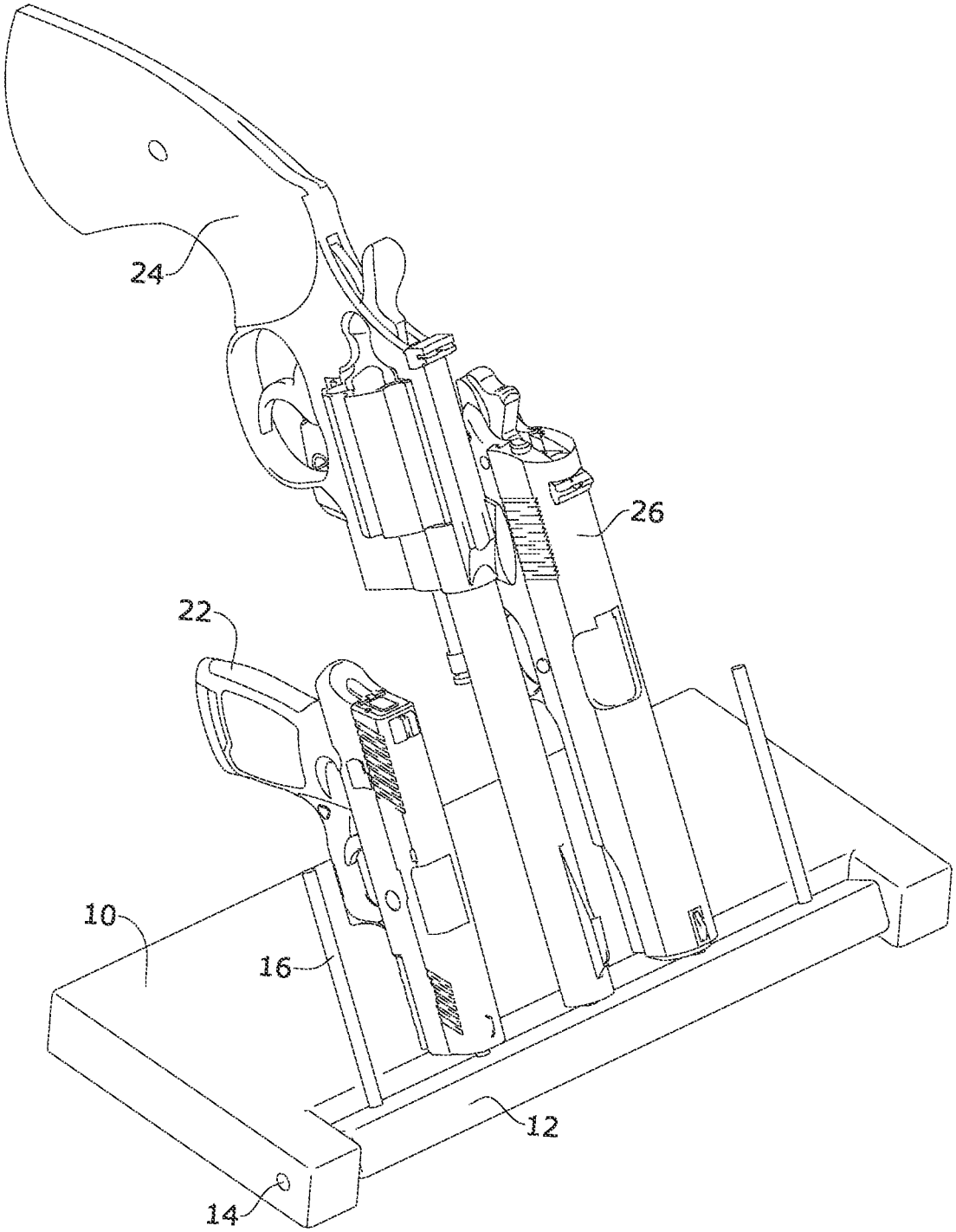
FIG. 1 is a perspective view of a modular cleaning, display, and storage rack for firearms, shown in use.
Figure 2:
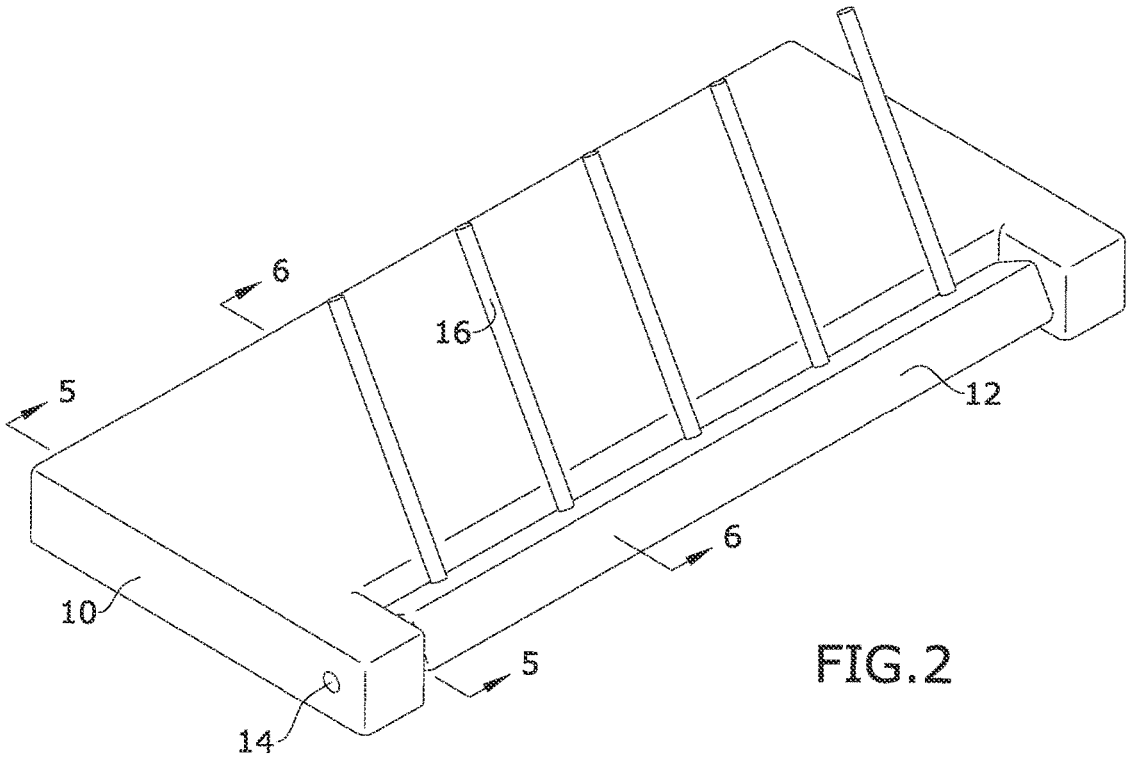
FIG. 2 is a perspective view of the modular cleaning, display, and storage rack for firearms.
Figure 3:
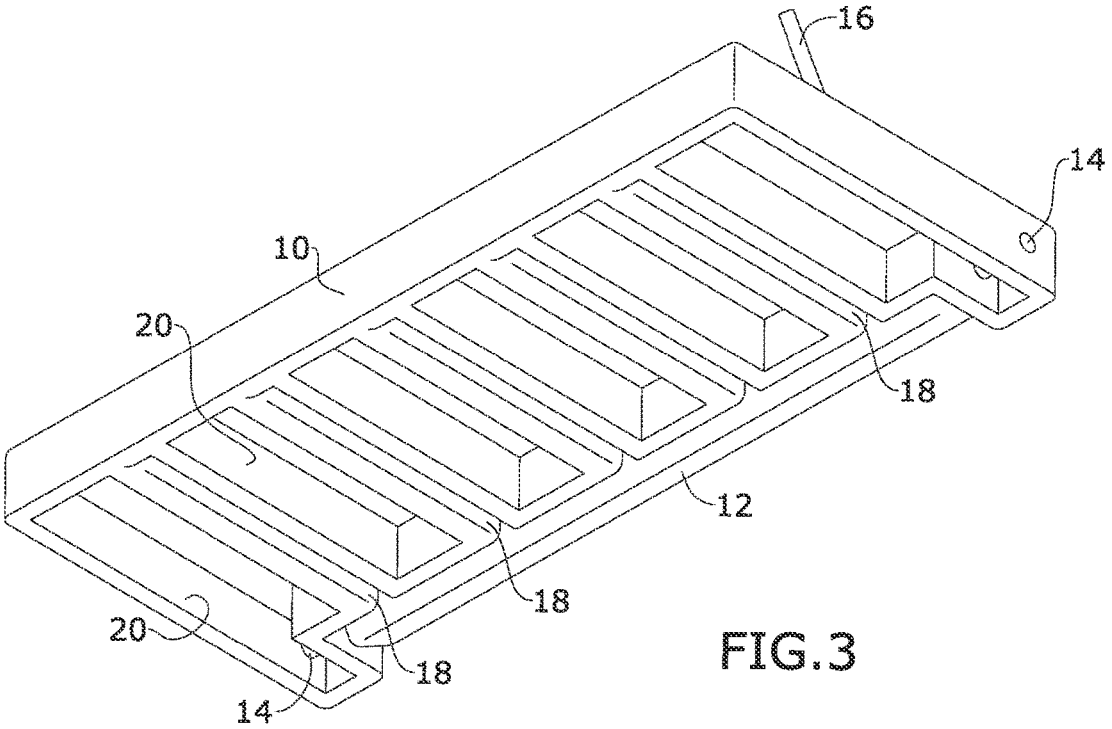
FIG. 3 is a bottom perspective view of the modular cleaning, display, and storage rack for firearms.
Figure 4:
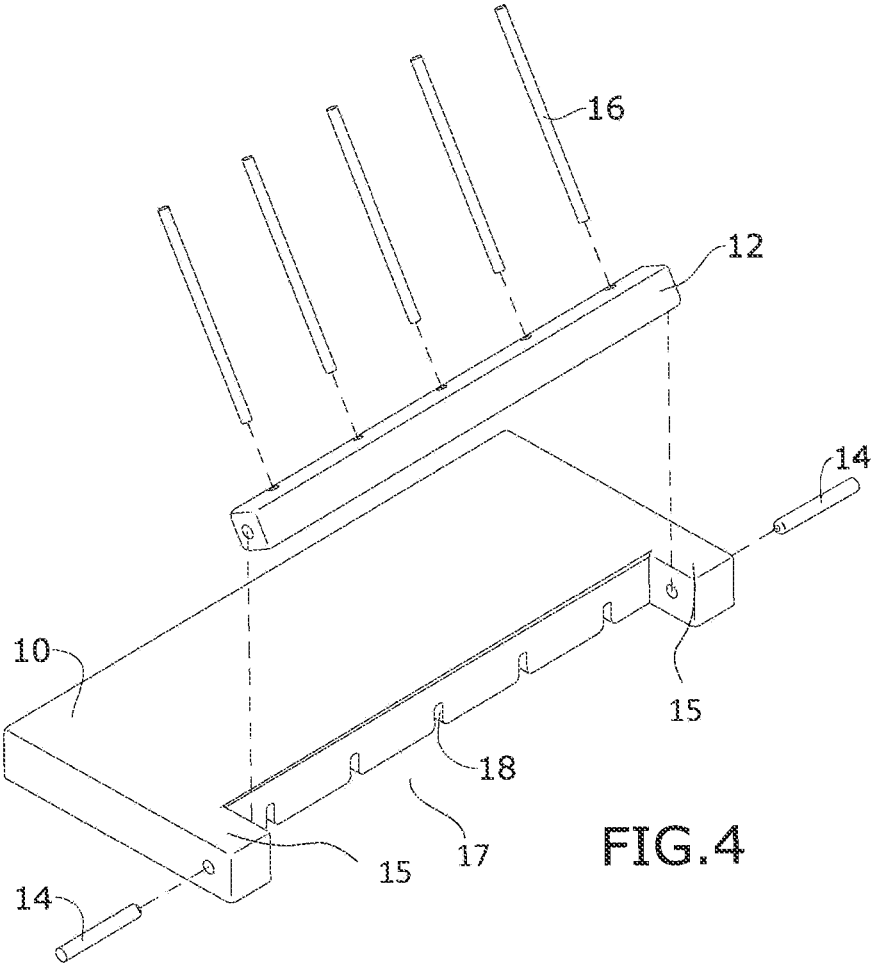
FIG. 4 is an exploded view of the modular cleaning, display, and storage rack for firearms.
Figure 5:
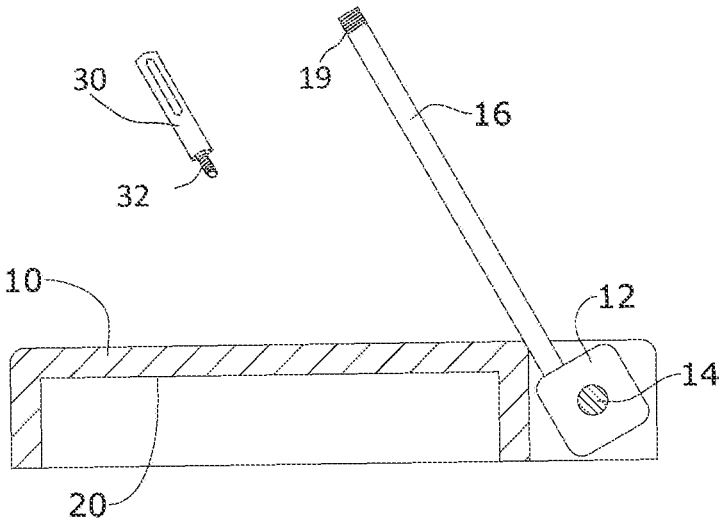
FIG. 5 is a section view, taken along 5-5 of FIG. 2.
Figure 6:
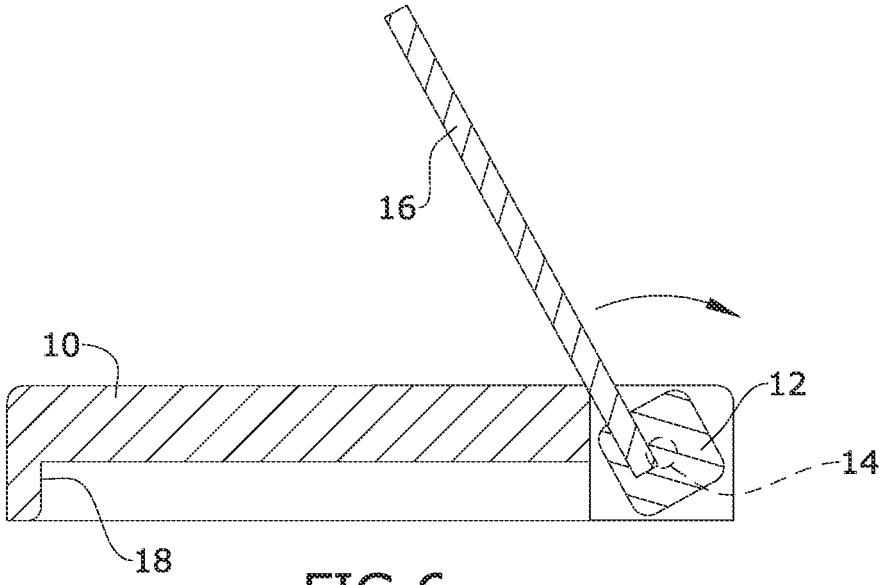
FIG. 6 is a section view, taken along 6-6 of FIG. 2.
Figure 7:
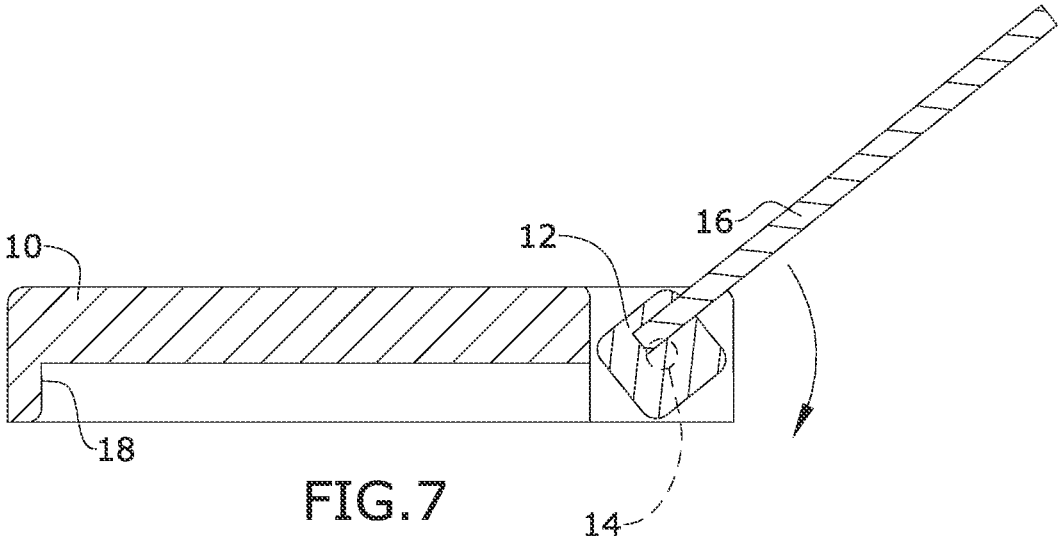
FIG. 7 is a front view showing rods moving to a closed position.
Figure 8:
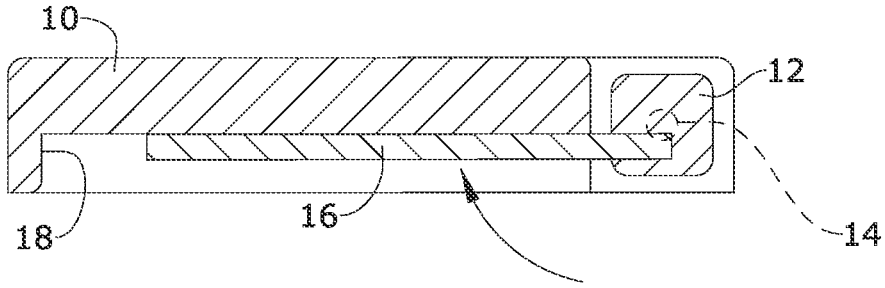
FIG. 8 is a front view showing rods in the closed position.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a modular cleaning, display, and storage rack for firearms. The modular cleaning, display, and storage rack for firearms is operable between a stowed position, in which it is substantially flat to facilitate storage or transport of the rack, and an open position, in which the rack can support one or more firearms in for storage, display, or cleaning of the firearm.

Embodiments of the modular cleaning, display, and storage rack for firearms are shown in reference to the drawings of FIGS. 1-10. The modular cleaning, display, and storage rack for firearms includes a base 10 and a plurality of support rods 16 that are movably coupled with the base via a hinge 12. The hinge 12 is coupled with the base 10 via a hinge pin 14.

The plurality of support rods 16 are disposed in a spaced apart relation along a longitudinal length of the hinge 12. In the open position, the plurality of support rods 16 are angularly disposed to overly the base 10. The angle may be on the order of about 60 degrees. In the open position, the support rods 16 are adapted to be received within a barrel of the firearm 22, 24, 26 and support the firearm 22, 24, 26 in an elevated position above the base 10. A distal end of the support rod 16 may have a threaded end 19 to couple with a cooperating thread 32 of a cleaning tool 30, such as a brush, a swab holder, and the like, of a gun cleaning kit. As will be appreciated with the benefit of the present disclosure, each of the plurality of support rods 16 may be rotationally carried in unison about the hinge pin 14. Alternatively, each of the plurality of support rods 16 may be individually rotatable about the hinge pin 14. In some embodiments, the support rods 16 may be removably coupled with the hinge 12.

In the stowed position, the plurality of support rods 16 are rotated about the hinge pin 14 such that the plurality of support rods 16 are substantially aligned with a bottom surface of the base 10. In the first embodiment of FIGS. 1-8, the each of the plurality of support rods 16 are received within a channel 18 extending transversely across the bottom surface of the base 10. In some embodiments, a recess 20 may be interposed adjacent to each of the channels 18.

In the first embodiment of FIGS. 1-8, a hinge side of the base 10 has protruding arms 15 define a notch 17 along a longitudinal length of the base 10. In this embodiment, the notch 17 is dimensioned to receive the hinge 12 that is carried by the hinge pins 14. In the open position, the plurality of support rods 16 rest in abutment with an inner face of the notch 17 to retain the plurality of support rods 16 at the angular displacement above the base 10.

Figure 9:
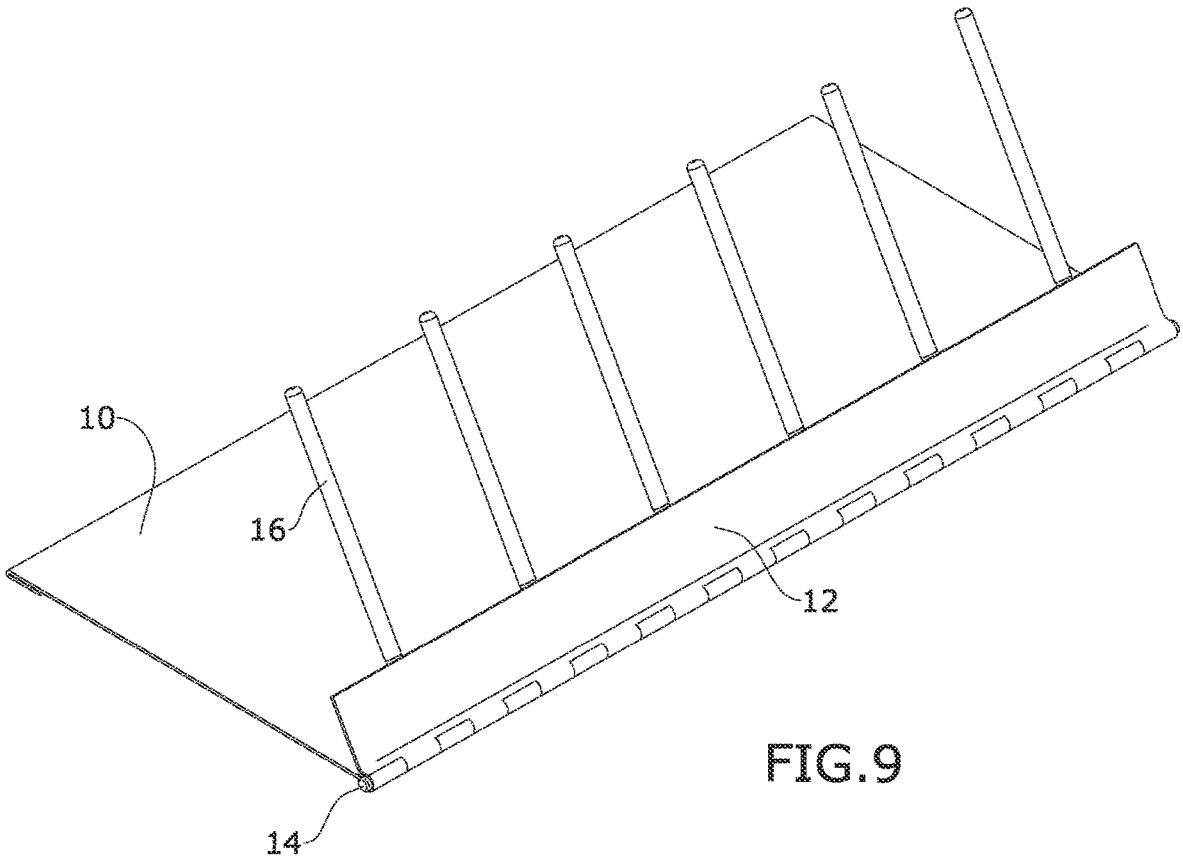
FIG. 9 is an alternate embodiment of the base and hinge, shown in perspective view.
Figure 10:
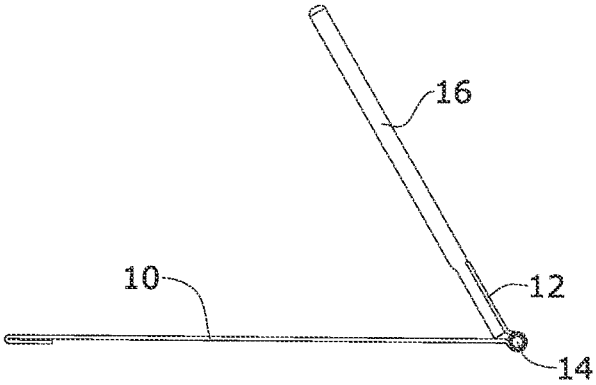
FIG. 10 is the alternate embodiment of the base and hinge, shown a side elevation view.
Figure 11:
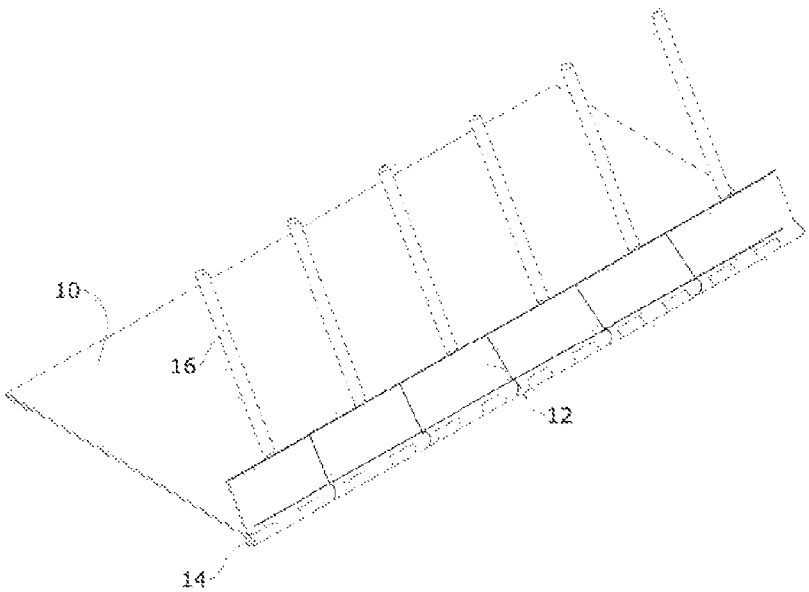
FIG. 11 is a perspective view of the alternate embodiment of the base and hinge, showing individually rotatable support rods.
Figure 12:
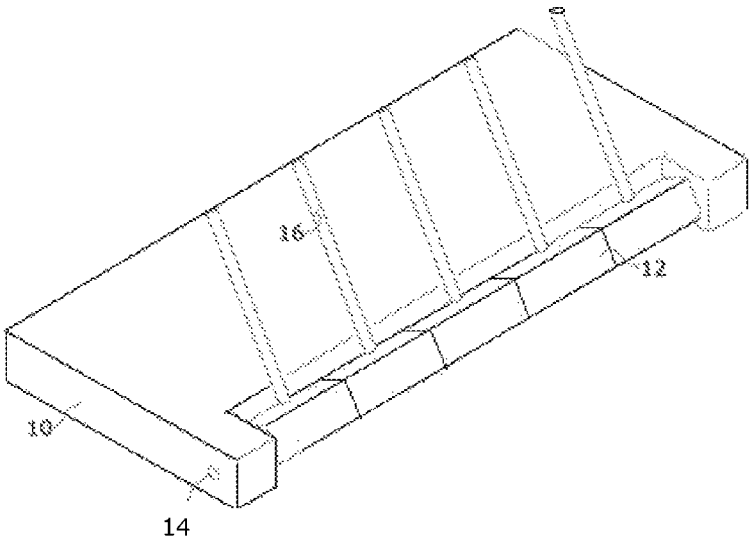
FIG. 12 is a perspective view of the modular cleaning, display, and storage rack for firearms, showing individually rotatable support rods.

In the embodiment shown in reference to FIGS. 9 and 10, the hinge 12 may be a piano hinge 12 rotationally carried on a hinge pin 14 relative to the base. In this embodiment, the hinge 12 is configured to retain the plurality of support rods 16 at the angular displacement above the base 10. A proximal end of the plurality of support rods 16 may abut a top surface of the base 10 in the open condition. In the closed position, the plurality of support rods 16 are oriented in alignment with a back surface of the base 10.

Advantageously, the modular cleaning, display, and storage rack for firearms may be carried in or integrated with a firearms cleaning kit. By way of non-limiting example the modular cleaning, display, and storage rack for firearms may be snap fit within or with an exterior of the case of the gun cleaning kit.

In use, the plurality of support rods 16 are rotated about the hinge and deployed to the open position. The barrel of a selected firearm 22, 24, 26 may then aligned with the support rod 16 and supported in an upright condition above the base 10. The selected firearm 22, 24, 26 may be supported for display, storage, or cleaning of the firearm 22, 24, 26.

When cleaning the firearm, a cleaning brush, swab holder, or other barrel cleaning tool 30 may be coupled with the threaded end 19 of the support rod 16. The barrel of the firearm 22, 24, 26 may then be advanced and retracted with the cleaning tool 30 and support rod 16 carried therein to clean the barrel of the firearm 22, 24, 26. The user may hold down the base 10, or the base 10 may otherwise be secured, to facilitate stability while advancing and retracting of the cleaning tool 30 in the barrel.

When the firearms 22, 24, 26 are removed from the modular cleaning, display, and storage rack for firearms may be folded to a transport and storage condition. The plurality of support rods 16 are rotated about the hinge pin 14 and aligned with a back surface of the base 10. In the closed, storage and transport condition, the modular cleaning, display, and storage rack for firearms presents a minimum cross-sectional profile and may be conveniently stacked with other modular cleaning, display, and storage racks for storage and transport.

It should be understood, of course, that the foregoing relates to exemplary embodiments of the invention and that modifications may be made without departing from the spirit and scope of the invention as set forth in the following claims.

What is claimed is:

1. A storage rack for a firearm, comprising:

a base formed as a substantially flat plate having a front surface and a back surface;

a hinge operable along a longitudinal length of the base and rotationally coupled with the base via a hinge pin; and a plurality of support rods disposed in a spaced apart relation along a longitudinal length of the hinge, each of the plurality of support rods dimensioned to be received within a barrel of the firearm, the plurality of support rods operable between a stowed position, in which the plurality of support rods are substantially aligned with the back surface of the base, and an open position, in which the plurality of support rods are carried in an angular orientation overlying the front surface of the base.

2. The storage rack of claim 1, further comprising:

an arm protruding from each of a first end and a second end of the base defining a notch along the longitudinal length of the base; wherein the hinge pin is received in each arm and the hinge is rotationally received within the notch.

3. The storage rack of claim 2, wherein, in the open position, the plurality of support rods abut with an inner edge of the notch.

4. The storage rack of claim 1, further comprising:

a recess defined in the back surface of the base; the recess dimensioned to receive the plurality of support rods when moved to the stowed position.

5. The storage rack of claim 4, wherein the recess comprises:

a channel defined transversely across the back surface of the base.

6. The storage rack of claim 1, wherein the hinge is a piano hinge, wherein in the open position, a proximal end of the plurality of support rods abut a top surface of the base to maintain the plurality of support rods in the angular orientation.

7. The storage rack of claim 1, wherein of the plurality of support rods are rotationally carried on the hinge for rotation in unison about the hinge pin.

8. The storage rack of claim 1, wherein each of the plurality of support rods are individually rotatable about the hinge pin.

9. A storage rack for a firearm, comprising:

a base having a front surface and a back surface;

a plurality of support rods disposed in a spaced apart relation along a longitudinal length of the base, each of the plurality of support rods dimensioned to be received within a barrel of the firearm, the plurality of support rods rotationally coupled with the base and operable between a stowed position, in which the plurality of support rods are substantially aligned with the back surface of the base, and an open position, in which the plurality of support rods are carried in an angular orientation overlying the front surface of the base.

10. The storage rack of claim 9, further comprising:

an arm protruding from each of a first end and a second end of the base defining a notch along the longitudinal length of the base; and a hinge is rotationally received within the notch, wherein the plurality of support rods are carried on the hinge.

11. The storage rack of claim 9, further comprising:

a recess defined in the back surface of the base; the recess dimensioned to receive the plurality of support rods when moved to the stowed position.

12. The storage rack of claim 11, wherein the recess comprises:

a channel defined transversely across the back surface of the base.

13. The storage rack of claim 9, further comprising:

a piano hinge disposed along a longitudinal length of the base, the piano hinge carrying the plurality of support rods, wherein in the open position, a proximal end of the plurality of support rods abut a top surface of the base to maintain the plurality of support rods in the angular orientation.

14. The storage rack of claim 9, wherein of the plurality of support rods are rotationally carried on the hinge for rotation in unison about the base.

15. The storage rack of claim 1, wherein each of the plurality of support rods are individually rotatable about the base.

16. A storage rack for a firearm, comprising:

a base formed as a substantially flat plate having a front surface and a back surface;

a hinge operable along a longitudinal length of the base and rotationally coupled with the base via a hinge pin, the hinge having a plurality of couplings disposed in a spaced apart relation along a longitudinal length of the hinge, and a plurality of support rods dimensioned to be received within a barrel of the firearm, each of the plurality of support rods having a proximal end and a distal end, the proximal end adapted to be received in one of the plurality of couplings, the distal end having a thread adapted to couple with a gun cleaning tool, the support rod operable between a stowed position, in which the support rod is substantially aligned with the back surface of the base, and an open position, in which the support rod is carried at an angular orientation overlying the front surface of the base.

* * * * *